US007739784B2

(12) United States Patent
Chen et al.

(10) Patent No.: US 7,739,784 B2
(45) Date of Patent: Jun. 22, 2010

(54) METHOD OF MAKING AN ANTENNA ASSEMBLY

(75) Inventors: Chao Chen, Waterloo (CA); Timothy H. Kyowski, Brantford (CA)

(73) Assignee: Research In Motion Limited, Waterloo (CA)

( * ) Notice: Subject to any disclaimer, the term of this patent is extended or adjusted under 35 U.S.C. 154(b) by 51 days.

(21) Appl. No.: 12/128,782

(22) Filed: May 29, 2008

(65) Prior Publication Data

US 2008/0222877 A1 Sep. 18, 2008

Related U.S. Application Data

(63) Continuation of application No. 11/676,342, filed on Feb. 19, 2007, now Pat. No. 7,394,434, which is a continuation of application No. 11/274,121, filed on Nov. 16, 2005, now Pat. No. 7,196,671, which is a continuation of application No. 10/723,838, filed on Nov. 26, 2003, now Pat. No. 7,053,842.

(60) Provisional application No. 60/430,082, filed on Dec. 2, 2002.

(30) Foreign Application Priority Data

Nov. 29, 2002 (CA) ..... 2413360

(51) Int. Cl.
*H01P 11/00* (2006.01)
*H01Q 1/24* (2006.01)

(52) U.S. Cl. ..... 29/600; 29/601; 29/884; 343/702

(58) Field of Classification Search ..... 29/600, 29/601, 592.1, 593, 832, 846; 343/702, 846, 343/901, 906, 700 MS, 713; 340/572.1–572.6; 174/35 R See application file for complete search history.

(56) References Cited

U.S. PATENT DOCUMENTS 3,383,645 A * 5/1968 Milanese et al. ..... 439/847

(Continued)

FOREIGN PATENT DOCUMENTS

EP 0261778 3/1988

(Continued)

OTHER PUBLICATIONS

European Examiner's Report pursuant to Article 94(3) EPC, EP 07114799.5 dated Feb. 10, 2009.

(Continued)

*Primary Examiner*—Minh Trinh
(74) *Attorney, Agent, or Firm*—Moffat & Co.

(57) ABSTRACT

A method for installing a grounding clip into an antenna tube, comprising providing the antenna tube having a cylindrical tube, an upper end and an inner end opposite the upper end, a circumferentially extending groove in the cylindrical tube located between the upper end and the inner end and a tapered lip at the inner end of the cylindrical tube, providing the grounding clip having a resilient base ring, the base ring having an outer circumference for contact with the antenna tube and a gap in the base ring and at least one resiliently flexible contact pin being affixed to and extending from a first end of the base ring, deforming the grounding clip, inserting the deformed grounding clip over the circumferentially extending groove and releasing the clip to allow the clip to expand, wherein the expanded clip is held between the circumferentially extending groove and the tapered lip.

9 Claims, 6 Drawing Sheets

U.S. PATENT DOCUMENTS

| | | | | | |
|---|---|---|---|---|---|
| 4,024,542 | A | | 5/1977 | Idawa et al. | |
| 4,730,195 | A | | 3/1988 | Phillips et al. | |
| 4,847,629 | A | | 7/1989 | Shimazaki | |
| 4,857,939 | A | | 8/1989 | Shimazaki | |
| 4,890,114 | A | | 12/1989 | Egashira | |
| 5,090,925 | A | | 2/1992 | Sato et al. | |
| 5,214,434 | A | | 5/1993 | Hsu | |
| 5,218,370 | A | | 6/1993 | Blaese | |
| 5,232,382 | A | | 8/1993 | Karlovich | |
| 5,334,055 | A | | 8/1994 | Sato et al. | |
| 5,422,651 | A | | 6/1995 | Chang | |
| 5,523,768 | A | | 6/1996 | Hemmie et al. | |
| 5,539,417 | A | * | 7/1996 | Terry et al. | 343/702 |
| 5,541,609 | A | | 7/1996 | Stutzman et al. | |
| 5,764,191 | A | * | 6/1998 | Tsuda | 343/702 |
| 5,821,907 | A | | 10/1998 | Zhu et al. | |
| 5,880,696 | A | * | 3/1999 | Koleda | 343/702 |
| 5,945,953 | A | * | 8/1999 | Tsuda et al. | 343/702 |
| 6,034,639 | A | | 3/2000 | Rawlins et al. | |
| 6,064,341 | A | | 5/2000 | Hassemer | |
| 6,215,446 | B1 | * | 4/2001 | Sullivan et al. | 343/702 |
| 6,285,340 | B1 | * | 9/2001 | Park et al. | 343/895 |
| 6,573,868 | B2 | | 6/2003 | Johnson et al. | |
| 6,639,562 | B2 | | 10/2003 | Suganthan et al. | |
| 6,756,943 | B2 | | 6/2004 | Kim et al. | |
| 6,788,259 | B2 | | 9/2004 | Amano et al. | |
| 6,839,033 | B2 | | 1/2005 | Shimbara et al. | |
| 2001/0001554 | A1 | | 5/2001 | Oshiyama | |
| 2002/0101380 | A1 | | 8/2002 | Pruss et al. | |

FOREIGN PATENT DOCUMENTS

| | | |
|---|---|---|
| EP | 0476848 | 5/2008 |
| GB | 2344937 | 6/2000 |
| JP | 55147806 | 11/1980 |
| JP | 5129816 | 5/1993 |
| JP | 5267916 | 10/1993 |
| JP | 06067712 | 4/1994 |
| WO | 9733338 | 9/1997 |
| WO | 0171844 | 10/2001 |
| WO | 02054539 | 7/2002 |

OTHER PUBLICATIONS

Patent Abstracts of Japan, vol. 18, No. 364 (E-1575), Jul. 8, 1994-& JP 06097712 A (Yokowo Co Ltd), Apr. 8, 1994.

* cited by examiner

METHOD OF MAKING AN ANTENNA ASSEMBLY

RELATED APPLICATIONS

The present application is a continuation of U.S. patent application Ser. No. 11/676,342 filed Feb. 19, 2007, which is a continuation of U.S. Pat. No. 7,196,671, filed Nov. 16, 2005, which is a continuation of U.S. Pat. No. 7,053,842, entitled "Combination Of Tube Assembly and Clip for Wireless Antenna Grounding" filed Nov. 26, 2003, which claimed priority from Canadian application Serial No. 2,413,360, entitled "Combination of Tube Assembly and Clip For Wireless Antenna Grounding" filed Nov. 29, 2002 and U.S. provisional application Ser. No. 60/430,082, entitled "Combination Of Tube Assembly and Clip for Wireless Antenna Grounding" filed Dec. 2, 2002. The full disclosure, including the drawings, of U.S. patent application Ser. No. 11/676,342, U.S. Pat. No. 7,196,671, U.S. Pat. No. 7,053,842, Canadian application No. 2413360 and U.S. provisional application Ser. No. 60/430,082 are incorporated herein by reference.

FIELD OF THE INVENTION

The present invention relates to antenna grounding and mounting technology, and specifically to the mounting and grounding of an antenna in a mobile device.

BACKGROUND

In order to maximize signal reception and minimize noise, a good ground for an antenna is required. Unfortunately, in many mobile devices where the antenna is stored in a retracted state, proper grounding is not realized. This is generally the result of improper contact between the antenna contact block and a ground in the antenna tube assembly.

Further, even when an antenna does have a ground in a fully retracted position, in many cases this ground is ineffective when the antenna is not completely retracted. This can occur if a user fails to push the antenna completely into its mount, but rather leaves it partially extended.

Another problem with present grounding techniques occurs during assembly of the antenna, where the mounting tube can move axially. This axial movement shifts the fully retracted position of the antenna, resulting in ineffective grounding if the antenna requires a fully retracted position to be grounded properly.

A further problem with retractable antennae is that they can convey water into the antenna tube when they move from an extended state to a retracted state, especially when the mobile device is used in the rain.

SUMMARY OF THE INVENTION

The present invention overcomes the shortcomings of the prior art by providing a superior antenna tube and clip combination for an antenna. Specifically, the present invention includes a clip that is inserted into the end of an antenna tube. The clip includes at least one contact pin extending axially along the antenna tube, providing an extended surface for an antenna contact block to make contact when the contact block is in a retracted state. The length of the contact area allows contact even when the antenna is not fully retracted. Further resilient forces in the contact clip ensure that good contact is made with the antenna contact block.

The present invention further has a flange at one end of the mounting tube in order to significantly reduce the possibility of axial movement during manufacturing. This flange fits into a groove that is located on a printed circuit board (PCB). The flange and groove can be created with high precision, thus providing a constant position for the fully retracted state of the antenna once the tube is mounted to the PCB. Without this groove and flange, slight axial movement of the tube could cause the contact point for a fully retracted antenna to shift towards or away from a mounting on the housing of the device within which the antenna is installed. By having a constant contact distance between the housing mount and the fully retracted position, grounding is facilitated.

The present invention further has an easy way to waterproof the antenna by providing a plastic tube that is mounted within an antenna tube assembly and captures any water conveyed into the tube assembly by a retracting antenna. The use of a cap at the other end of the tube ensures no water can enter from that end.

The present invention therefore provides a method for installing a grounding clip into an antenna tube, the antenna tube comprising a cylindrical tube having an upper end and an inner end opposite said upper end; a circumferentially extending groove in said cylindrical tube located between said upper end and said inner end; and a tapered lip at the inner end of said cylindrical tube, the grounding clip comprising: a resilient base ring, said base ring having an outer circumference for contact with the antenna tube and a gap in said base ring; and at least one resiliently flexible contact pin being affixed to and extending from a first end of the said base ring, the method comprising: deforming the grounding clip; inserting the deformed grounding clip over said circumferentially groove; and releasing the clip to allow the clip to expand, whereby said expanded clip is help between said circumferentially extending groove and said tapered lip.

DETAILED DESCRIPTION OF THE DRAWINGS

Figure 1:
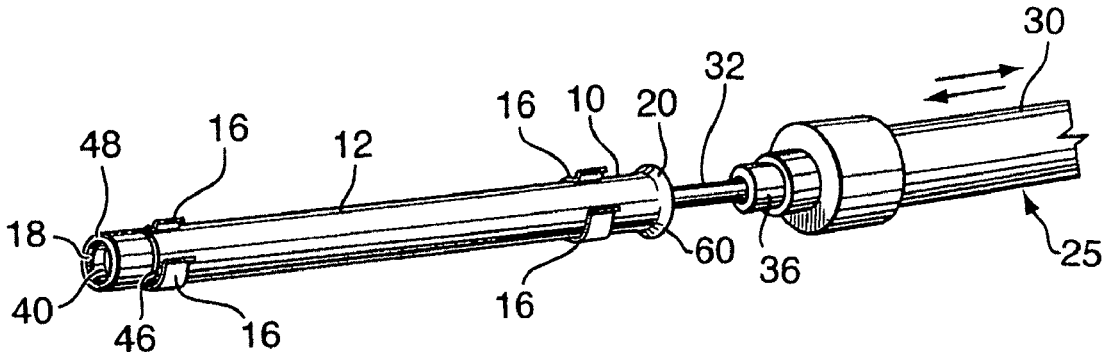
FIG. 1 is a perspective view of the antenna tube and mount assembly of the present invention.
Figure 2:
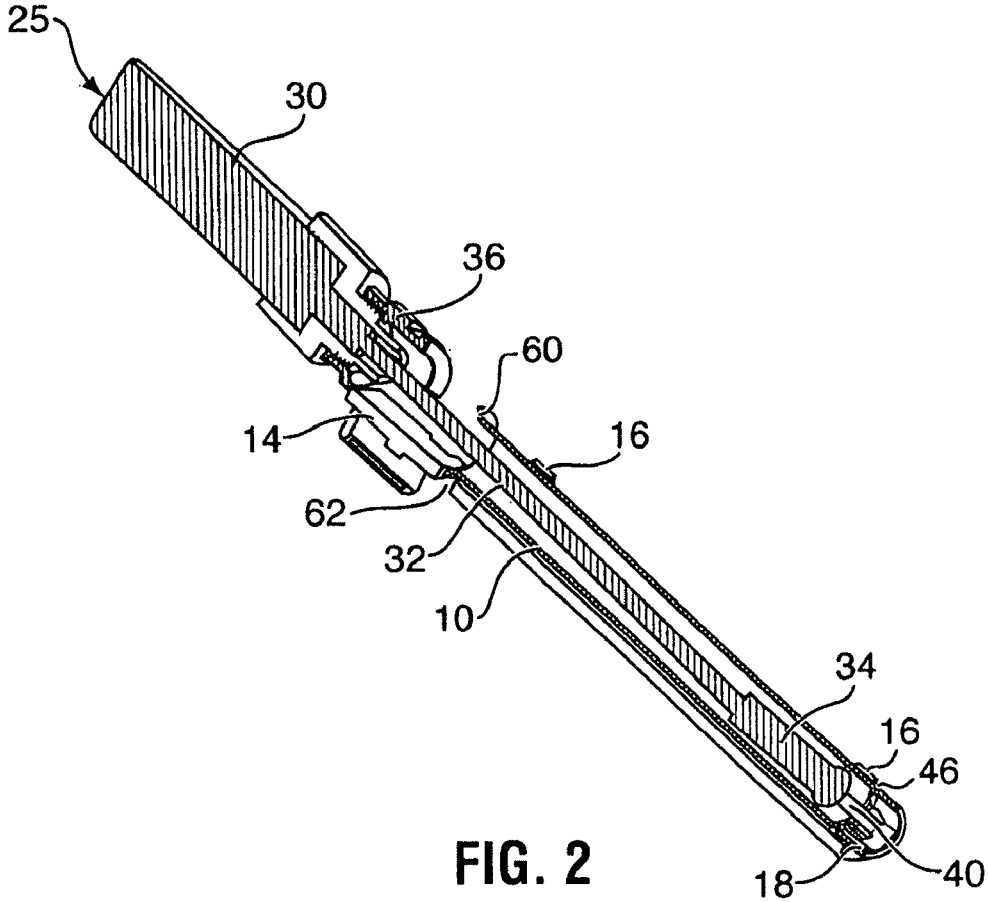
FIG. 2 is a cross sectional view of the antenna tube and mount assembly.

Reference is now made to FIGS. 1 and 2. FIGS. 1 and 2 show a tube assembly 10 for a retractable antenna 25. Tube assembly 10 includes an outer metal wall 12 that is formed to a precise inner diameter ensuring very little deviation.

Tube assembly 10 is mounted to a printed circuit board (PCB) 14 using surface mount technology clips (SMT) 16. SMT clips provide an electrical contact between tube assembly 10 and PCB 14.

Figure 3:
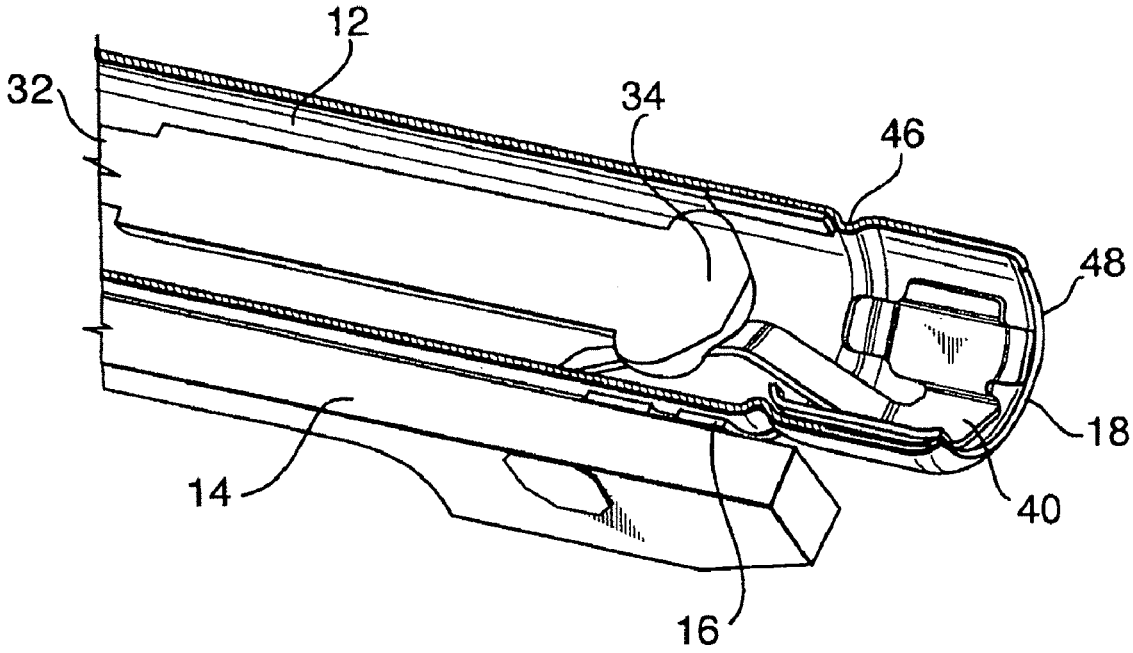
FIG. 3 is a cross sectional view of the contact end of the antenna tube and mount.
Figure 4:
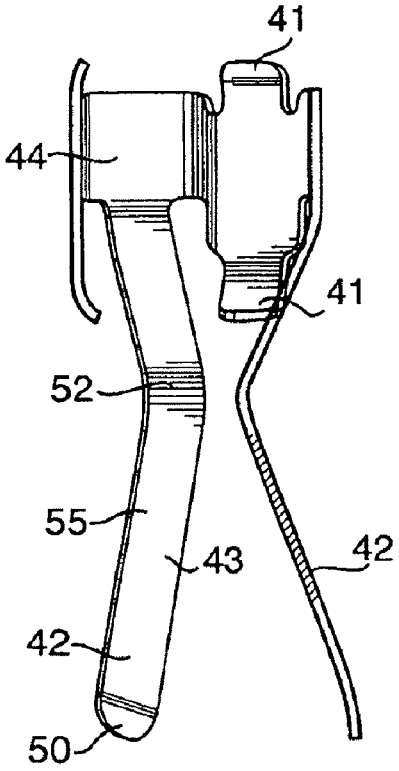
FIG. 4 is a rear side elevational view of the grounding clip of the present invention.
Figure 5:
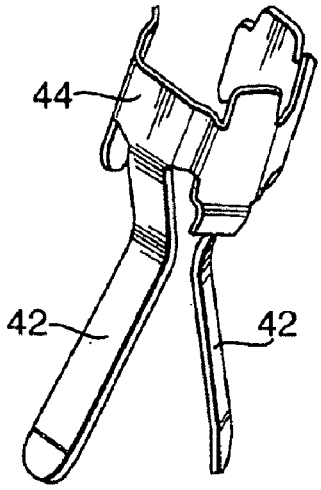
FIG. 5 is a top perspective view of the grounding clip of FIG. 4.
Figure 6:
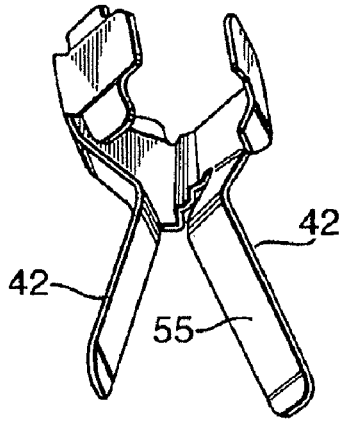
FIG. 6 is a bottom perspective view of the grounding clip.
Figure 7:
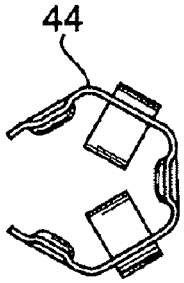
FIG. 7 is a top plan view of the grounding clip.
Figure 8:
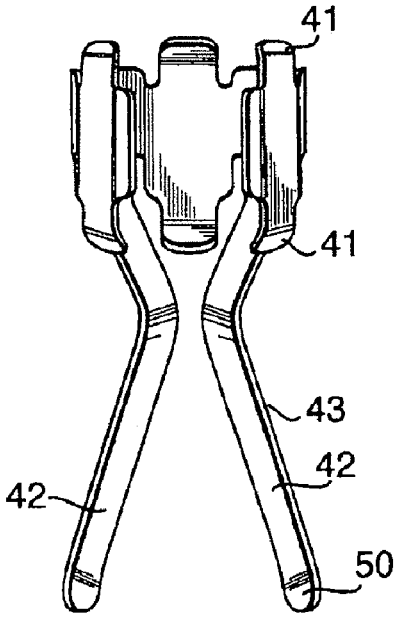
FIG. 8 is a front side elevational view of the grounding clip.
Figure 9:
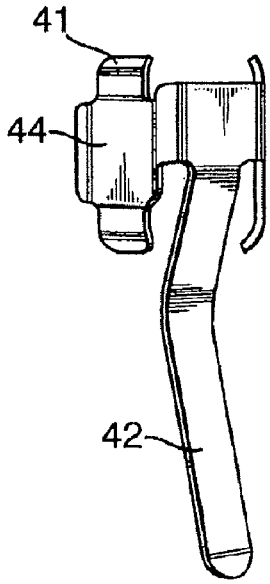
FIG. 9 is a left side elevational view of the grounding clip.
Figure 11:
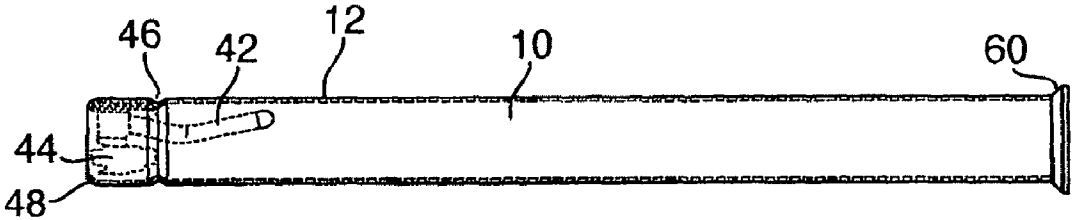
FIG. 11 is a partial cross sectional view of the tube and grounding clip of the present invention showing more of the tube.
Figure 14:
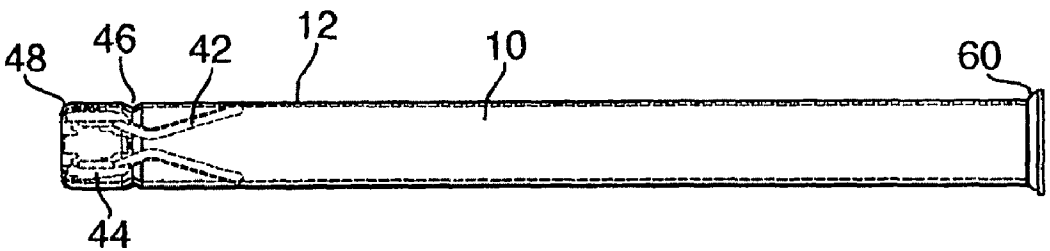
FIG. 14 is a partial cross sectional view of the tube and grounding clip of the present invention.
Figure 13:
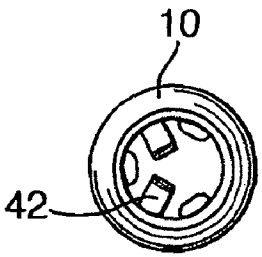
FIG. 13 is an end view of the tube and grounding clip of FIG. 11.
Figure 10:
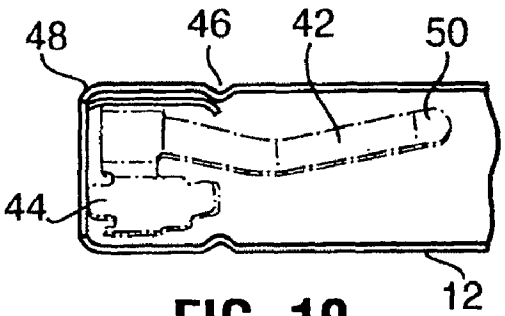
FIG. 10 is a partial cross sectional view of the tube and grounding clip of the present invention.
Figure 12:
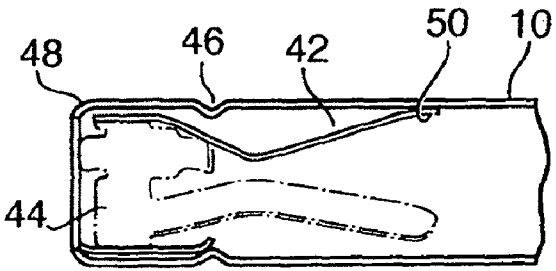
FIG. 12 is a partial cross sectional view of the tube and grounding clip of FIG. 11 rotated to a different angle.

Antenna 25 includes an external protective sheath 30 at the antenna's outer tip, an antenna shaft 32, and a contact block 34 (seen more clearly in FIG. 3). Antenna 25 is held at the shaft's upper end to the hand held device using a mount 36. Mount 36 provides some stability for antenna 25 and further provides some weather protection for tube assembly 10 to limit the ingress of water.

A user can extend antenna 25 by pulling external sheath 30 outwardly relative to the hand held device. This causes antenna shaft 32 to move through mount 36, pulling antenna contact block 34 with it. Contact block 34 moves from a position near the inner end 18 of tube assembly 10 to a position towards the outer end 20 of tube assembly 10.

Similarly, retraction is performed by pushing external protective sheath 30 towards the hand held device, causing antenna contact block 34 to move towards inner end 18 of tube assembly 10.

In order to facilitate grounding, the present invention is provided with a conductive and typically metal grounding clip 40. Grounding clip 40 is best seen in FIGS. 3 to 15.

Clip 40 consists of at least one, but preferably two resiliently flexible contact pins 42 connected to or formed integrally with a base ring 44.

In operation, grounding clip 40 is installed into the inner open end 18 of tube assembly 10. Tube assembly 10 is formed with a circumferentially extending groove 46 that is used to hold grounding clip 40 in place. Specifically, clip 40 can be inserted into tube 10 until base ring 44 snap fits securely into the space between groove 46 and the tubers inwardly curved lip 48 with both the insertion of the clip and, if necessary, its removal, being facilitated by the angled tabs 41 at the inner and outer ends of the base ring 44.

The end of tube assembly 10 is preferably formed into a tapered lip 48. Clip 40 is then installed into the space between groove 46 and lip 48 using some elastic deformation of the clip to fit it over lip 48. Preferably, a small jig is used to accomplish this insertion. Grounding clip 40 is thus locked in place between the tapered lip 48 of tube assembly 10 and groove 46.

Each contact pin 42 is essentially dog legged in shape which provides for clearance between each pin and groove 46 and allows the longer portion 43 of each pin to taper from the dog leg's apex 52 to tab 50 that is adapted to bear against the tube 10's inner surface. The surface 55 of each pin portion 43 between apex 52 and tab 50 is a flexible contact area for making electrical contact between clip 40 and contact block 34 at the inner end of the antenna's shaft as the antenna is fully or partially retracted.

Figure 15:
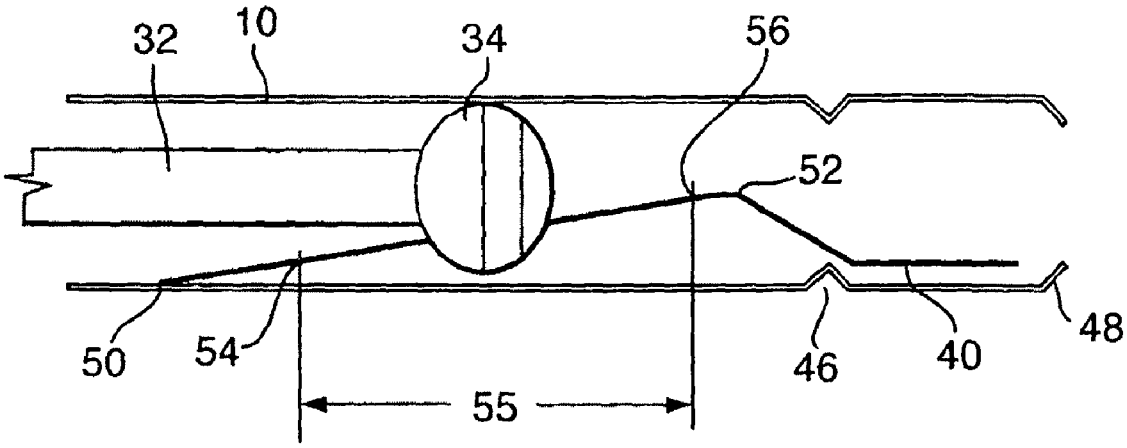
FIG. 15 is a schematical cross-sectional view of the tube and grounding clip of the present invention.

Reference is now made to FIG. 15. FIG. 15 shows that if antenna contact block 34 is located between points 54 and 56 of contact area 55, contact pin 42 makes physical and electrical contact with the antenna contact block 34. Contact pin 42 is preferably gold plated within this area to ensure optimal contact and hence grounding.

Grounding clip 40 is preferably formed through a progressive stamping die. This ensures that the clip has very well controlled dimensions for consistent installation within each tube assembly 10. This ensures that pins 42 have very good repeatable positions when compared between one tube assembly 10 and another.

The slope between points 54 and 56 is designed to produce an optimal contact area. This is done by ensuring that the contact area 55 is as long as possible, and that contact pin 42 is resiliently flexible. This assembly creates a long contact area 55 that produces more chances for the grounding of antenna 25. Specifically, antenna 25 does not need to be fully retracted into the tube in order to achieve proper grounding.

In a preferred embodiment, clip 40 includes two contact pins 42. The use of two pins ensures that proper contact is maintained with antenna contact block 34 by providing a three contact grounding. The first two contact points are between block 34 and the two contact areas 55 on contact pins 42. Further, the spring forces produced by contact pins 42 on antenna contact block 34 will force antenna contact block 34 into contact with the inside of tube assembly 10, created a third grounding point as shown most clearly in FIG. 15. The optimal configuration for contact pins 42 will not be diametrically opposed to one another, but rather at an angle of between 90 and 120 degrees from one another.

Figure 16:
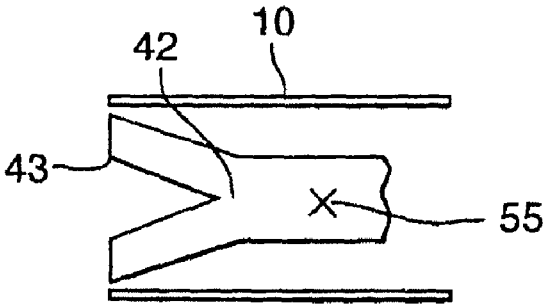
FIG. 16 is a schematical plan view of an alternative contact pin for the grounding clip of the present invention.
Figure 17:
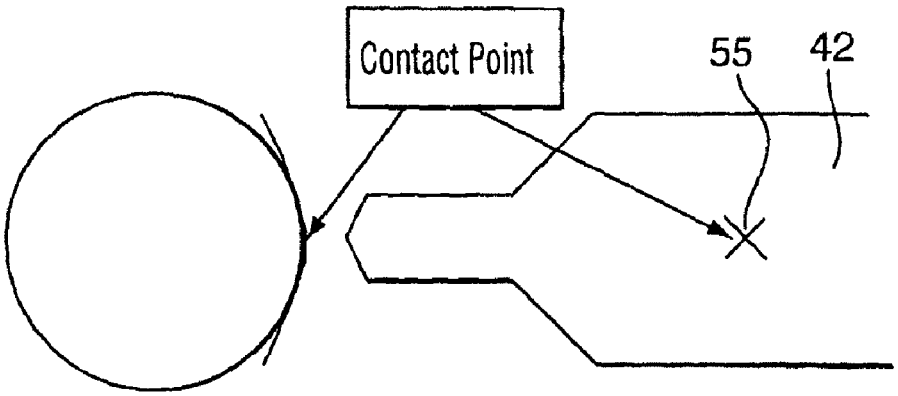
FIG. 17 is a schematical plan view of another alternative contact pin for the grounding clip of the present invention.

One skilled in the art will realize that other configurations for contact pins 42 are possible. One contact pin could, for example, be used as long as the pin was sufficiently stable to provide a good contact area 55. Reference is now made to FIGS. 16 and 17, which show alternative configurations for contact pin 42. In FIG. 16, a contact pin 42 is shown with a forked end 43. Forked end 43 provides sufficient stability to ensure contact pin 42 does not move when antenna contact block 34 is retracted.

Alternatively, contact pin 42 can be curved, as illustrated in FIG. 17. FIG. 17 shows contact pin 42 with a single contact point 55 at one end. However, contact area 55 is curved to fit around antenna contact block 34, ensuring contact pin 42 is not moved to the side of antenna contact block 34 when antenna 25 is retracted.

Grounding is further facilitated through the mounting of tube assembly 10 onto PCB 14. As indicated above, tube assembly 10 is mounted to PCB 14 using surface mount technology clips 16. Two SMT clips 16 are used, and these clips 16 connect to associated clips on PCB 14. Clips 16 will hold tube assembly 10 in the X and Y directions. The combination of two clips will restrict rotation in the X and Y axes.

Figure 18:
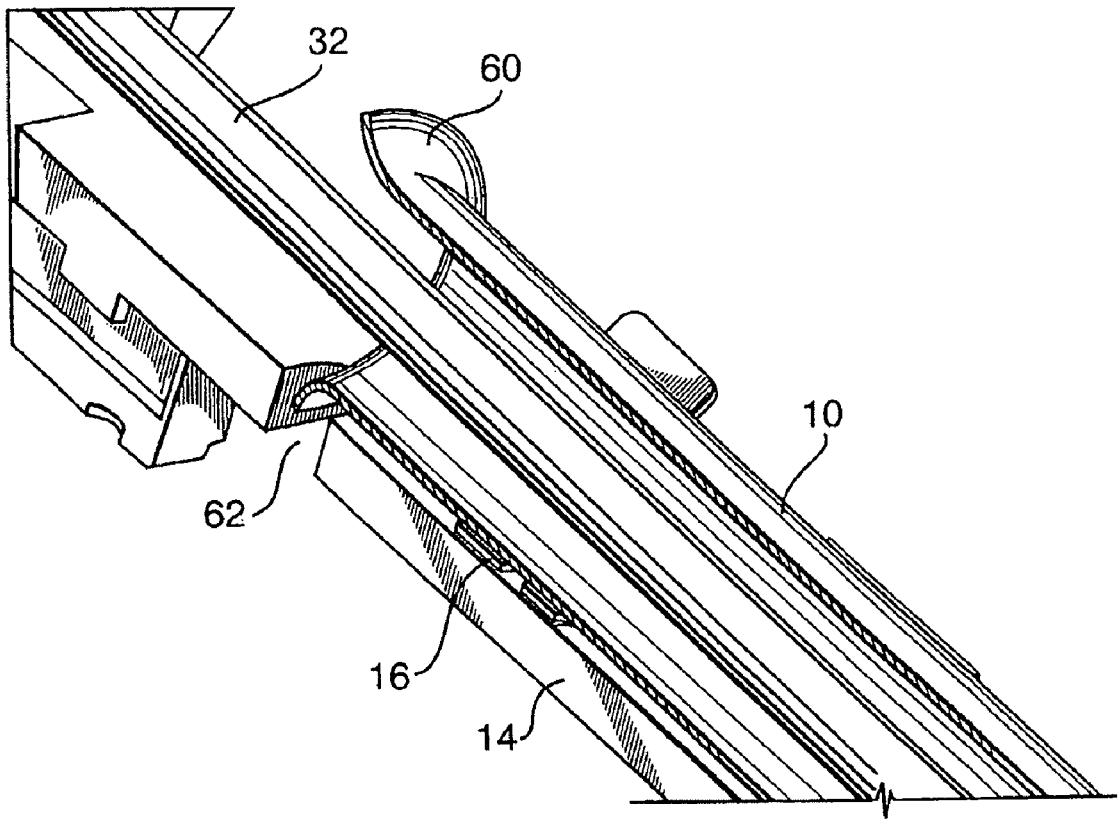
FIG. 18 is a cross sectional view of the flange and groove assembly of the present invention.

Reference is now made to FIG. 18. The present invention further includes a radially extending flange 60 at the front or upper end of tube assembly 10. Flange 60 fits into a groove 62 cut into PCB 14. The combination of flange 60 and groove 62 ensures that tube assembly 10 will not move in the tubers axial direction.

One advantage of the above mounting technique is that contact performance will be improved. If the tube were allowed to move axially, the retraction point of antenna contact block 34 would vary, thus making accurate grounding more difficult to achieve. The use of flange 60 and groove 62, which can both be manufactured for high precision, ensures that tube assembly 10 is always mounted correctly in the axial direction. This mounting technique only allows rotation about the axis of the tube assembly 10. This does not affect the contact of retracted antenna 25, and thus does not affect the grounding performance.

After the tube is completely assembled, one skilled in the art will appreciate that plastic components in the housing will also aid in holding the tube assembly 10 in the correct position.

The present invention further provides for improved waterproofing by providing a tube 70 within tube assembly 10. Water may enter tube assembly 10 from mount 36 when antenna 25 is retracted. This is overcome by plastic tube 70 and cap 72.

Figure 19:
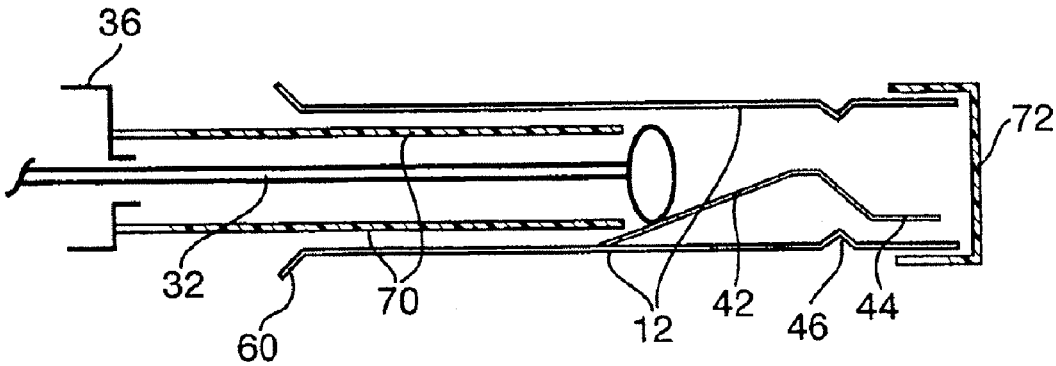
FIG. 19 is a schematical cross-sectional view of the tube assembly of the present invention including waterproofing components.

Reference is made to FIG. 19. Tube 70 is preferably fabricated from plastic and is affixed to mount 36. Tube 70 extends from mount 36 to contact area 55. Preferably, a small gap exists between tube 70 and tube assembly 10 to facilitate insertion of plastic tube 70 into tube assembly 10. Further, even after the housing of the mobile device is closed, plastic tube 70 can be inserted into tube assembly 10 using the opening for mount 36.

In operation, water that may collect on shaft 30 because of rain can be pushed into mount 36 when antenna 25 is retracted. This water will stay in tube 70 rather than contact the side of tube assembly 10.

Further waterproofing is accomplished by adding a cap 72 at the end of tube assembly 10. Cap 72 can be comprised of metal or plastic, and fits snugly on the end of tube assembly 10, thus providing a seal.

The above-described embodiments of the present invention are meant to be illustrative of preferred embodiments and are not intended to limit the scope of the present invention. Also, various modifications, which would be readily apparent to one skilled in the art, are intended to be within the scope of the present invention. The only limitations to the scope of the present invention are set forth in the following claims appended hereto.

The invention claimed is:

1. A method for installing a grounding clip into an antenna tube, the method comprising:

providing the antenna tube having a cylindrical tube having an upper end and an inner end opposite said upper end, a circumferentially extending groove in said cylindrical tube located between said upper end and said inner end and a tapered lip at the inner end of said cylindrical tube;

providing the grounding clip having a resilient base ring, said base ring having an outer circumference for contact with the antenna tube and a gap in said base ring and at least one resiliently flexible contact pin being affixed to and extending from a first end of the said base ring;

deforming the grounding clip;

inserting the deformed grounding clip over said circumferentially extending groove; and releasing the clip to allow the clip to expand, wherein said expanded clip is held between said circumferentially extending groove and said tapered lip.

2. The method of claim 1, wherein the inserting allows said resiliently flexible contact pin to extend over said circumferentially extending groove.

3. The method of claim 1, further comprising adding a cap at the inner end of said tube assembly.

4. The method of claim 3, wherein the cap provides a seal for said tube.

5. The method of claim 1, further comprising mounting the antenna tube onto a printed circuit board.

6. The method of claim 1, wherein the deforming is accomplished by compressing the base ring to eliminate said gap.

7. The method of claim 1, wherein the clip consists of two resiliently flexible contact pins.

8. The method of claim 1, wherein the clip further consists of angled tabs at an inner end thereof, said angle tabs allowing said clip to deform over said circumferentially extending groove.

9. The method of claim 1, wherein said clip further consists of angled tabs at an outer end thereof, said angle tabs at the outer end of said clip allowing said clip to be removed from said tube by deforming said clip over said circumferentially extending groove.

* * * * *